United States Patent [19]

Itsubo et al.

[11] Patent Number: 4,520,939

[45] Date of Patent: Jun. 4, 1985

[54] PILFER-PROOF PLASTIC CLOSURE FOR CONTAINERS

[75] Inventors: Junichi Itsubo; Takashi Yazaki, both of Hiratsuka; Fumio Mori, Yokohama, all of Japan

[73] Assignee: Japan Crown Cork Co., Ltd., Tokyo, Japan

[21] Appl. No.: 581,845

[22] Filed: Feb. 21, 1984

[30] Foreign Application Priority Data

Jan. 18, 1984 [JP] Japan ..... 59-5756

[51] Int. Cl.[3] ..... B65D 41/34

[52] U.S. Cl. ..... 215/252

[58] Field of Search ..... 215/252

[56] References Cited

U.S. PATENT DOCUMENTS 4,418,828 12/1983 Wilde et al. ..... 215/252

*Primary Examiner*—Donald F. Norton

*Attorney, Agent, or Firm*—Beveridge, DeGrandi & Weilacher

[57] ABSTRACT

A pilfer-proof plastic closure comprising a top panel wall and a cylindrical skirt wall extending downwardly from the peripheral edge of the top panel wall. The skirt wall has formed therein a circumferentially extending breakable line dividing the skirt wall into a main portion above the breakable line and a pilfer-proof bottom portion below it. The main portion has formed on its inner surface an internal thread and the pilfer-proof bottom portion has formed on its inner surface a plurality of radially inwardly projecting engaging flaps at circumferentially spaced positions. Each of said engaging flaps has a first portion extending from the inner surface of the pilfer-proof bottom portion tiltedly in a direction opposite to the direction of rotation of the closure at the time of mounting it on the mouth-neck portion of a container and a second portion bent with respect to the first portion and further extending from the end of the first portion. The first portion forms an angle $\alpha$ smaller than 90 degrees and the second portion forms an angle $\beta$ larger than the angle $\alpha$, both with respect to the tangent of the inner surface of the pilfer-proof bottom portion at the base edge of the engaging flap.

5 Claims, 6 Drawing Figures

PILFER-PROOF PLASTIC CLOSURE FOR CONTAINERS

FIELD OF THE INVENTION

This invention relates to a pilfer-proof plastic closure for containers, and more specifically, to a pilfer-proof plastic closure for application to a container equipped with a mouth-neck portion having an external thread on its peripheral surface and a holding jaw portion beneath the external thread.

DESCRIPTION OF THE PRIOR ART

Pilfer-proof metallic closures for containers holding various drinks have recently been superseded by pilfer-proof plastic closures. A typical example of such plastic container closures is disclosed in Japanese Laid-Open Patent Publication No. 74445/1981 and U.S. Pat. No. 4,418,828.

The closure disclosed in these patent documents has a top panel wall and a cylindrical skirt wall extending downwardly from the peripheral edge of the top panel wall. A circumferentially extending breakable line is formed in the skirt wall to divide it into a main portion above the breakable line and a pilfer-proof bottom portion below it. An internal thread is formed on the inner surface of the main portion, and a plurality of radially inwardly projecting engaging flaps are formed on the inner surface of the pilfer-proof bottom portion at circumferentially spaced positions.

The plastic closure of the above structure is applied to a container equipped with a mouth-neck portion having an external thread formed on its peripheral surface and a holding jaw portion located beneath the external thread. To close the mouth-neck portion of the container with the closure, the closure is put over the mouth-neck portion and turned in a closing direction to fit the external thread of the mouth-neck portion in the internal thread of the closure. As a result, the closure turns in the closing direction with respect to the mouth-neck portion and at the same time, moves axially downwardly. At this time, the holding jaw portion formed on the outer surface of the mouth-neck portion interferes with the engaging flaps formed on the inner surface of the pilfer-proof bottom portion to elastically bend them radially outwardly. When the engaging flaps completely go past the holding jaw portion, they elastically return radially inwardly and are held to the undersurface of the holding jaw portion. To open the mouth-neck portion of the container, the closure is turned in an opening direction which is reverse to the closing direction. As a result, the internal thread of the closure is moved along the external thread of the mouth-neck portion, and therefore, the closure turns in the opening direction and simultaneously moves axially upwardly. The pilfer-proof bottom portion of the closure, however, cannot move axially upwardly because the engaging flaps formed on its inner surface engage the undersurface of the holding jaw portion of the mouth-neck portion. This results in a considerable stress on the breakable line formed in the skirt wall of the closure. Consequently, the breakable line is completely broken to separate the skirt wall into the main portion and the pilfer-proof bottom portion. Or the breakable line is broken while leaving a part of it, and at the same time, an axially extending breakable line provided in the pilfer-proof bottom portion is broken to open the endless annular pilfer-proof bottom portion into a tape form.

Thereafter, the closure is removed from the mouth-neck portion either entirely or while leaving the separated pilfer-proof bottom portion. The mouth-neck portion of the container is thus opened.

It is important that container closure of the above structure and function should meet the following two requirements. Firstly, in closing the mouth-neck portion of the container with the closure, the engaging flaps should be easily bendable elastically in the radially outward direction during their passage over the holding jaw portion, so as to mount the closure on the mouth-neck portion with a relatively low rotating torque and to accurately prevent generation of an excessive stress on the breakable line which will result in its breakage. Secondly, in opening the mouth-neck portion of the container, the engaging flaps should fully accurately engage the holding jaw portion so as to accurately prevent the closure from slipping out of the mouth-neck portion without the breakage of the breakable line as a result of the engaging flaps going past the holding jaw portion while being bent radially outwardly. It will be appreciated that if this slipping occurs, the pilfer-proof characteristics of the closure will be impaired. In order for the closure to meet these two requirements, it is necessary to reduce sufficiently the downwardly rotating torque which must be exerted on the closure when the engaging flaps are passed over the holding jaw portion axially downwardly from above, to increase sufficiently the upwardly rotating torque which must be exerted on the closure when the engaging flaps are passed over the holding jaw portion axially upwardly from below, and to adjust the breaking rotating torque which must be exerted on the closure for breaking the breakable line as desired to a value between the required downwardly rotating torque and the required upwardly rotating torque.

In conventional container closures, however, no sufficient difference can be set up between the required downwardly rotating torque and the required upwardly rotating torque, and frequently, owing to errors in production, the containers do not meet the aforesaid first or second requirement.

SUMMARY OF THE INVENTION

It is a primary object of this invention to provide a pilfer-proof plastic container closure which has been improved such that a sufficient difference is set up between the required downwardly rotating torque and the required upwardly rotating torque by sufficiently decreasing the former and sufficiently increasing the latter and consequently the closure accurately meets the aforesaid first and second requirements.

In a conventional plastic closure, each of the engaging flaps in its entirety is tilted in a direction opposite to the rotating direction of the closure during mounting on the mouth-neck portion of a container and extends continuously in a straight line from the inner surface of the pilfer-proof bottom portion. Extensive investigations and experiments of the present inventors have now led to the discovery that by making each of the engaging flaps from a first portion extending tiltedly in a direction opposite to the direction of the rotating direction of the closure during mounting on the mouth-neck portion of a container and a second portion bent with respect to the first portion and further extending from the end of the first portion, and adjusting the angle of the first portion to the tangent of the inner surface of the pilfer-proof bottom portion at the base edge of the engaging flap to an angle $\alpha$ which is smaller than 90 degrees and the angle of the second portion to said tangent to an angle $\beta$ which is larger than the angle $\alpha$, the aforesaid required upwardly rotating torque can be increased considerably while supressing the increase of the required downwardly rotating torque, and consequently, the aforesaid object can be achieved.

Thus, according to this invention, there is provided a pilfer-proof plastic closure for a container equipped with a mouth-neck portion having an external thread formed on its peripheral surface and a holding jaw portion located below the external thread, said closure comprising a top panel wall and a cylindrical skirt wall extending downwardly from the peripheral edge of the top panel wall, said skirt wall having formed therein a circumferentially extending breakable line dividing the skirt wall into a main portion above the breakable line and a pilfer-proof bottom portion below it, said main portion having formed on its inner surface an internal thread to be engaged with the external thread on the mouth-neck portion of the container and said pilfer-proof bottom portion having formed on its inner surface a plurality of radially inwardly projecting engaging flaps at circumferentially spaced positions; each of said engaging flaps having a first portion extending from the inner surface of the pilfer-proof bottom portion tiltedly in a direction opposite to the direction of rotation of the closure at the time of mounting it on the mouth-neck portion of the container and a second portion bent with respect to the first portion and further extending from the end of the first portion, and the first portion forming an angle $\alpha$ smaller than 90 degrees and the second portion forming an angle $\beta$ larger than the angle $\alpha$, both with respect to the tangent of the inner surface of the pilfer-proof bottom portion at the base edge of the engaging flap.

DETAILED DESCRIPTION OF PREFERRED EMBODIMENTS

The improved plastic container of the invention will be described in detail hereinbelow with reference to the accompanying drawings showing its preferred embodiments.

Figure 1:
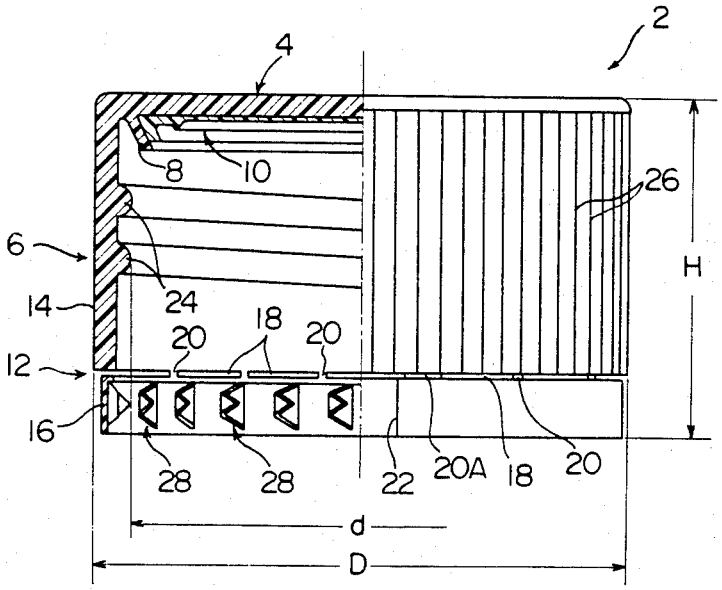
FIG. 1 is a side elevation partly in section of one embodiment of the container closure improved in accordance with this invention.

With reference to FIG. 1, the container closure shown generally at 2 has a one-piece main body comprised of a circular top panel wall 4 and a cylindrical skirt wall 6 extending downwardly from the peripheral edge of the top panel wall 4. The main body can be formed by compression molding or injection molding of a suitable plastic material such as polyolefinic resins.

In the illustrated embodiment, an annular projection 8 is formed on the inner surface of the top panel wall 4, and a sealing liner 10 is separately formed in the annular projection. The sealing liner 10 can be formed at a required position, for example after fabrication of the main body, by a well known molding method from a suitable plastic material. If desired, instead of forming the sealing liner separately from the main body, a sealing projection of a suitable form may be integrally formed on the inner surface of the top panel wall 4.

A circumferentially extending breakable line 12 is formed in the skirt wall 6, and the skirt wall 6 is thus divided into a main portion 14 above the the breakable line 12 and a pilfer-proof bottom portion 16 below it. The breakable line 12 may, for example, be a so-called score formed by reducing the thickness of the material of which the skirt wall is made. In the illustrated embodiment, the breakable line is comprised of a plurality of circumferentially extending slits (cut channels) 18 spaced from each other circumferentially and a plurality of bridging portions 20 left among the slits 18. The pilfer-proof bottom portion 16 is connected to the main portion 14 by the plurality of bridging portions 20. In the illustrated embodiment, a specified bridging portion 20A among the plurality of bridging portions 20 has a larger circumferential width and therefore a higher strength than the other bridging portions 20. At a position adjacent to the one side edge in the circumferential direction of the specified bridging portion 20A, an axially extending breakable line 22 is formed in the pilfer-proof bottom portion 16. The breakable line 22 may be a score or a perforation.

Figure 2:
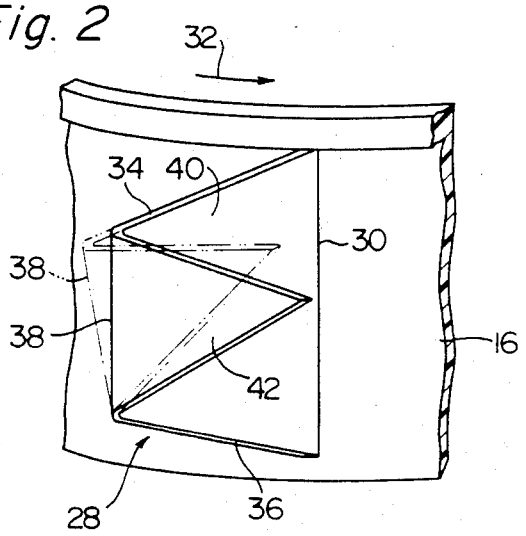
FIG. 2 is a partial perspective view showing an engaging flap in the container closure of FIG. 1.

As is clearly shown in FIG. 1, it is generally convenient that the main portion 14 of the skirt wall 6 has a relatively large thickness, whereas the pilfer-proof bottom portion has a relatively small thickness. An internal thread 24 is formed on the inner surface of the main portion 14. Conveniently, raisings and depressions or knurls 26 are formed on the outside surface of the main portion 14 to prevent slippage of fingers during turning of the closure with the fingers. Furthermore, a plurality of (22 in the illustrated embodiment) circumferentially spaced engaging flaps 28 are formed on the inner surface of the pilfer-proof bottom portion 16. With reference to FIG. 2 together with FIG. 1, each of the engaging flaps 28 projects radially inwardly from its base edge connected to the inner surface of the pilfer-proof portion 16. In the illustrated embodiment, the base edge 30 of each engaging flap 28 extends substantially vertically in the axial direction of the container closure 2. If desired, however, the base edge 30 of each engaging flap 28 may be constructed so as to extend tiltedly at a suitable angle in a suitable direction with respect to the axial direction, i.e. the rotating direction of the closure 2 during its mounting on the mouth-neck portion of a container (the clockwise direction as seen from above in FIG. 1, and the direction shown by an arrow 32 in FIG. 2) or a direction opposite to the rotating direction. In the illustrated embodiment, the upper edge 34 of each of the engaging flaps 28 extends slightly inclinedly in the downward direction from the upper end of the base edge 30 toward its free end, and the lower edge 36 of each of the engaging flaps 28 extends slightly inclinedly in the upward direction from the lower end of the base edge 30 toward its free end.

The above-described structure of the container closure 2 does not constitute any novel feature of the container closure improved in accordance with this invention, and only shows one example of a container closure to which the invention is applicable.

Figure 3:
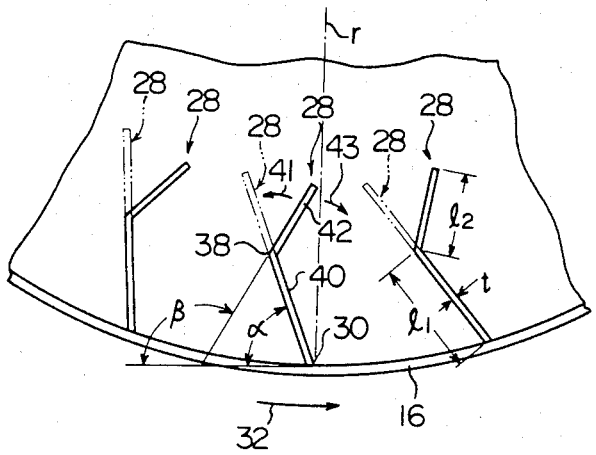
FIG. 3 is a partial bottom view showing the engaging flap in the container closure of FIG. 1.

It is critical in accordance with this invention that a bent portion should be formed in each of the engaging flaps 28. With reference to FIGS. 2 and 3 taken in conjunction with FIG. 1, each of the engaging flaps 28 is bent along a bending line 38 and has a first portion 40 ranging from the base edge 30 to the bending line 38 and a second portion 42 ranging from the bending line 38 to the free end. In the illustrated embodiment, the bending line 38 extends substantially parallel to the base edge 30 and therefore substantially vertically in the axial direction of the container closure 2. If desired, as shown by a two-dot chain line in FIG. 2, the bending line 38 may be caused to extend axially downwardly in a direction shown by arrow 32 (i.e., the rotating direction of the closure 2 during its mounting on the mouth-neck portion of a container) or a direction opposite to it. The first portion 40 extends from the inner surface of the pilfer-proof bottom portion 15, i.e. the base edge 30, to the bending line 38 while it is inclined in a direction opposite to the direction shown by arrow 32 in FIGS. 2 and 3 (therefore in the rotating direction of the closure 2 during its mounting on the mouth-neck portion of a container, or the clockwise direction as viewed from above in FIG. 1). It is important that as clearly shown in FIG. 3, the first portion 40 should have an angle $\alpha$ smaller than 90 degrees to the tangent 44 of the inner surface of the pilfer-proof bottom portion 16 at the base edge 30. Preferably, the angle $\alpha$ is 30 to 85 degrees, particularly 50 to 80 degrees. On the other hand, it is important that the second portion 42 bent with respect to the first portion 40 and extending from the end of the first portion 40, i.e the bending line 30, to the free end of the flap should from an angle $\beta$ greater than the angle $\alpha$ to the tangent 44. The angle $\beta$ is preferably 60 to 180 degrees, particularly 90 to 160 degrees (therefore, the second portion 42 extends inclinedly in a direction opposite to the first portion 40, i.e. in the direction of arrow 32 in FIGS. 2 and 3). Preferably, the forward end of the second portion 42 is located rearwardly of a radial line connecting the base edge 30 to the central axis of the closure 2 when viewed in the direction of the arrow 32. If the second portion extends forwardly of the radial line as viewed in the direction of arrow 32, the engaging flaps 28 tend to be bent not in the direction shown by an arrow 41 in FIG. 3 but in the direction shown by an arrow 43 in FIG. 3 when the holding jaw portion formed in the mouth-neck portion of a container interferes with the second portion 42 during mounting of the closure 2 on the mouth-neck portion in the manner to be described.

Figure 4:
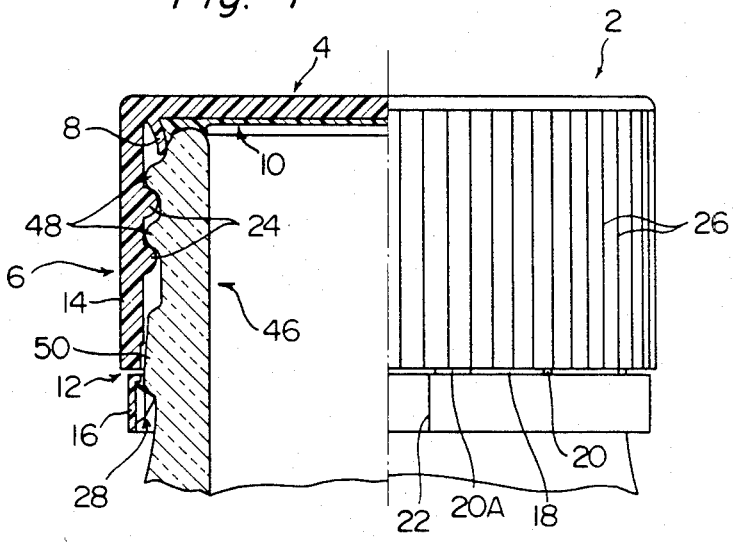
FIG. 4 is a side elevation partly in section of the state in which the container closure of FIG. 1 has been mounted on the mouth-neck portion of a container to close it.

The plastic closure 2 described above is applied to a container having a mouth-neck portion 46 of the structure depicted in FIG. 4. The mouth-neck portion 46 is known per se, and has a cylindrical peripheral surface. The peripheral surface has formed therein an external thread 48 and a holding jaw portion 50 located below the external thread 48.

Figure 5:
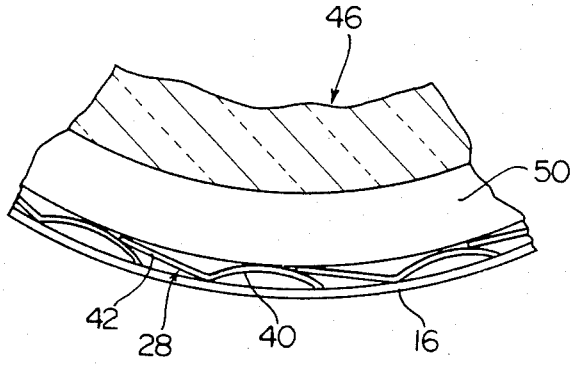
FIG. 5 is a partial sectional view showing the state of an engaging flap during the mounting of the container closure of FIG. 1 on the mouth-neck portion of a container.

In closing the mouth-neck portion 46 with the closure 2, the closure 2 is put over the mouth-neck portion and turned in a closing direction, that is, in the clockwise direction as viewed from above in FIG. 4. As a result, the internal thread 24 formed in the closure 2 is engaged with the external thread 48 formed in the mouth-neck portion 46, and the closure 2 is moved axially downwardly. Each of the engaging flaps 28 formed in the closure 2 thus goes past the external thread 48 formed on the mouth-neck portion 46 and further passes over the holding jaw portion 50. As shown in FIG. 5, during passage over the holding jaw portion 50, each of the engaging flaps 28 undergoes interference by the holding jaw portion 50 and is elastically bent radially outwardly. When the internal thread 24 of the closure 2 is fully engaged with the external thread 48, each of the engaging flaps 28 completely goes past the holding jaw portion 50 and is released from interference by the holding jaw portion 50. As a result, the engaging flaps 28 elastically returned to their original state.

It will be clearly understood from Example and Comparative Example given hereinbelow that the required downwardly rotating torque which must be exerted on the closure 2 of this invention during passage of the elastically bent engaging flaps 28 over the holding jaw portion 50 is nearly equal to that in a conventional container closure in which the second portion 42 of each engaging flap 28 is not bent with the first portion 40 but extends in a straight light with the first portion 40 as shown by a two-dot chain line in FIG. 3, and is therefore sufficiently low. Accordingly, during mounting of the closure 2 on the mouth-neck portion 46, the generation of an excessive stress on the breakable lines 12 and 22 can be surely prevented, and therefore, the breakable lines can be accurately prevented from breaking at this time.

Figure 6:
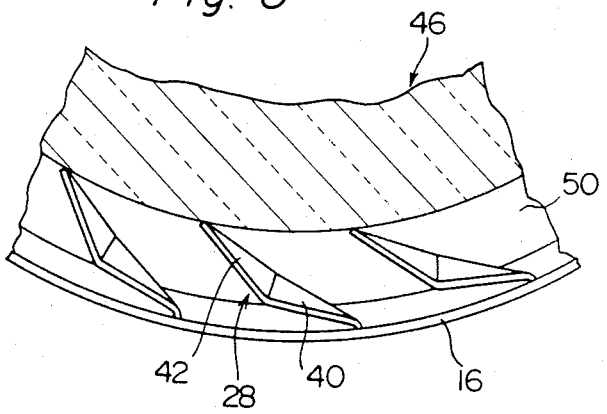
FIG. 6 is a partial sectional view showing the state of the engaging flap as shown in FIG. 4.

When the engaging flaps 28 fully return to their original state, they engage the undersurface of the holding jaw portion 50 as clearly shown in FIGS. 4 and 6. When the internal thread 24 of the closure 2 is in full engagement with the external thread on the mouth-neck portion 46, the sealing liner 10 is in intimate contact with the end surface portion of the mouth-neck portion 46, and thus seals up the mouth-neck portion 46.

To open the mouth-neck portion 46 by removing the closure 2 from it, the closure 2 is turned in a direction opposite to the rotating direction during mounting of the closure 2, that is, counterclockwise as viewed from above in FIG. 4. As a result, the internal thread 24 formed in the closure 2 is moved along the external thread 48 on the mouth-neck portion 46, and the closure 2 tends to move axially upwardly. However, the axially upward movement of the pilfer-proof bottom portion 16 is hampered since the engaging flaps 28 formed on the inner surface of the pilfer-proof bottom portion 16 engage the undersurface of the holding jaw portion 50 of the mouth-neck portion 46. Consequently, a considerable stress is exerted on the breakable line 12 formed in the closure 2, and the bridging portions 20 of the breakable line 12 are broken excepting the specified bridging portion 20A having a large circumferential width and an increased strength. A considerable stress is also exerted on the breakable line 22 formed in the pilfer-proof bottom portion 16 to break the breakable line 22, with the result that the endless annular pilfer-proof bottom portion 16 is opened into a tape form. As a result, the engagement of the engaging flaps 28 with the undersurface of the holding jaw portion 50 is released. Thereafter, the entire closure 2 including the pilfer-proof bottom portion 16 connected to the main portion 14 through the specified bridging portion 20A which remains unbroken is moved axially upwardly as it is turned. The entire closure 2 is thus removed from the mouth-neck portion 46. If the specified bridging portion 20A in the breakable line 12 has substantially the same strength as the other bridging portions and no breakable line 22 is formed in the pilfer-proof bottom portion 16, the breakable line 12 is completely broken and the pilfer-proof bottom portion 16 is completely separated from the main portion 14. Accordingly, while the pilfer-proof bottom portion 16 is left at the mouth-neck portion, all the other portions of the closure 2 are removed from the mouth-neck portion 46.

As will be clearly understood from the description of the following Example and Comparative Example, the engaging flaps 28 engage the undersurface of the holding jaw portion 50 more strongly in the closure 2 improved in accordance with this invention than in the conventional closure in which the second portion 42 of each engaging flap 28 is not bent with respect to the first portion 40 but extends in a straight line with the first portion 40 as shown by the two-dot chain line in FIG. 3. In other words, the required upwardly rotating torque which must be exerted on the closure 2 of this invention when the engaging flaps 28 are passed in the elastically bent state over the holding jaw portion 50 in the axially upward direction is made considerably higher than that on the conventional closure. Hence, the closure is surely prevented from being removed from the mouth-neck portion 46 without the desired breakage of the breakable lines 12 and 22, and the pilfer-proof characteristics of the closure 2 can be retained.

EXAMPLE

Ten closure bodies having substantially the same form as the main body of the closure 2 shown in FIGS. 1 to 3 except that the breakable line 12 and the breakable line 22 were not formed were molded from polypropylene having a melt index of 2.0 and a density of 0.90. Each closure body has an internal thread inside diameter, d, of 25.6 mm, an outside diameter, D, of 30.0 mm and a total height, H, of 19.0 mm. Each of the engaging flaps 28 had a thickness, t, of 0.35 mm. Its first portion 40 had a projecting length $l_1$ of 1.9 mm and an angle $\alpha$ of 70 degrees, and its second portion 42 had a projecting length $l_2$ of 1.4 mm and an angle $\beta$ of 117 degrees.

Each of the closure bodies was mounted on the mouth-neck portion 46 of a glass container having the form shown in FIG. 4 and a nominal diameter of 28 mm, and the required downwardly rotating torque was measured.

Thereafter, the closure body was forcedly removed from the mouth-neck portion 48, and the required upwardly rotating torque was measured. The results are shown in Table 1 below.

Comparative Example

For comparison, the same closure bodies as in Example were molded except that each of the engaging flaps 28 formed on the inner surface of the pilfer-proof bottom portion 16 had the form shown by the two-dot chain line in FIG. 3 (namely, the second portion 42 was not bent with respect to the first portion 40 but extended in a straight line with the first portion 40).

In the same way as in Example, the required downwardly rotating torque and the required upwardly rotating torque were measured. The results are shown in Table 1.

TABLE 1

| | Required downwardly rotating torque (kg-cm) | | | Required upwardly rotating torque (Kg-cm) | | |
|---|---|---|---|---|---|---|
| | Average | Maximum | Minimum | Average | Maximum | Minimum |
| Example | 2.2 | 2.5 | 1.5 | 8.7 | 10.0 | 7.5 |
| Comparative Example | 2.5 | 1.5 | 4.3 | 5.0 | 3.5 | 2.0 |

What we claim is:

1. A pilfer-proof plastic closure for a container equipped with a mouth-neck portion having an external thread formed on its peripheral surface and a holding jaw portion located below the external thread, said closure comprising a top panel wall and a cylindrical skirt wall extending downwardly from the peripheral edge of the top panel wall, said skirt wall having formed therein a circumferentially extending breakable line dividing the skirt wall into a main portion above the breakable line and a pilfer-proof bottom portion below it, said main portion having formed on its inner surface an internal thread to be engaged with the external thread on the mouth-neck portion of the container and said pilfer-proof bottom portion having formed on its inner surface a plurality of radially inwardly projecting engaging flaps at circumferentially spaced positions; each of said engaging flaps having a first portion extending from the inner surface of the pilfer-proof bottom portion tiltedly in a direction opposite to the direction of rotation of the closure at the time of mounting it on the mouth-neck portion of the container and a second portion bent with respect to the first portion and further extending from the end of the first portion, and the first portion forming an angle $\alpha$ smaller than 90 degrees and the second portion forming an angle $\beta$ larger than the angle $\alpha$, both with respect to the tangent of the inner surface of the pilfer-proof bottom portion at the base edge of the engaging flap.

2. The closure of claim 1 wherein the angle $\alpha$ is 30 to 85 degrees.

3. The closure of claim 2 wherein the angle $\alpha$ is 50 to 80 degrees.

4. The closure of claim 1 wherein the angle $\beta$ is 60 to 180 degrees.

5. The closure of claim 4 wherein the angle $\beta$ is 90 to 160 degrees.

* * * * *